United States Patent [19]

Takamura

[11] Patent Number: 4,876,840

[45] Date of Patent: Oct. 31, 1989

[54] BAG COVERING APPARATUS

[75] Inventor: Yoshiyuki Takamura, Nagoya, Japan

[73] Assignee: Fuji Pack System Ltd., Nagoya, Japan

[21] Appl. No.: 245,721

[22] Filed: Sep. 16, 1988

[30] Foreign Application Priority Data

Sep. 19, 1987 [JP] Japan ..... 62-235619
Aug. 8, 1988 [JP] Japan ..... 63-197656

[51] Int. Cl.[4] ..... B65B 7/02; B65B 57/04; B65B 61/14

[52] U.S. Cl. ..... 53/137; 53/64; 53/141; 53/296

[58] Field of Search ..... 53/64, 117, 120, 128, 53/134, 137, 138 R, 141, 290, 296, 487

[56] References Cited

U.S. PATENT DOCUMENTS

| | | | |
|---|---|---|---|
| 2,659,520 | 11/1953 | Reitzes | 53/137 |
| 2,697,533 | 12/1954 | Richard | 53/137 |
| 3,022,620 | 2/1962 | Gallet | 53/137 |
| 3,458,969 | 8/1969 | Hudson | 53/137 |
| 3,474,593 | 10/1969 | Hartbauer et al. | 53/137 |
| 3,543,466 | 12/1970 | Forsberg | 53/137 X |
| 3,766,707 | 10/1973 | Alexander | 53/137 X |
| 4,037,388 | 7/1977 | Bastasch | 53/64 |
| 4,091,595 | 5/1978 | Pelster et al. | 53/137 X |
| 4,567,711 | 2/1986 | Hodnett et al. | 53/128 |

*Primary Examiner*—Robert L. Spruill
*Assistant Examiner*—Beth Bianca
*Attorney, Agent, or Firm*—Arnold, White & Durkee

[57] ABSTRACT

A bag covering apparatus that puts a cover, which has been folded in two at the folding portion, on the opening of a bag. The same bag covering apparatus includes a folding piece which can operate to fold the cover in two at the folding portion and a cover retaining piece provided near the folding piece, having at least two holding portions capable of holding the folding portion of the cover. The folding portion of the cover is inserted into the holding portion of the cover retaining piece by the action of the folding piece, the cover retaining piece being movable such that when one of the holding pieces of the cover retaining piece faces the opening of the bag, the other holding piece of the cover retaining piece faces the folding piece. A linking piece is operationally linked to the cover retaining piece, making the opening of the bag and the holding portion of the cover retaining piece facing the opening of the bag approach each other by the action of the folding piece, positioning the cover on the opening of the bag.

12 Claims, 13 Drawing Sheets

FIG. 9a
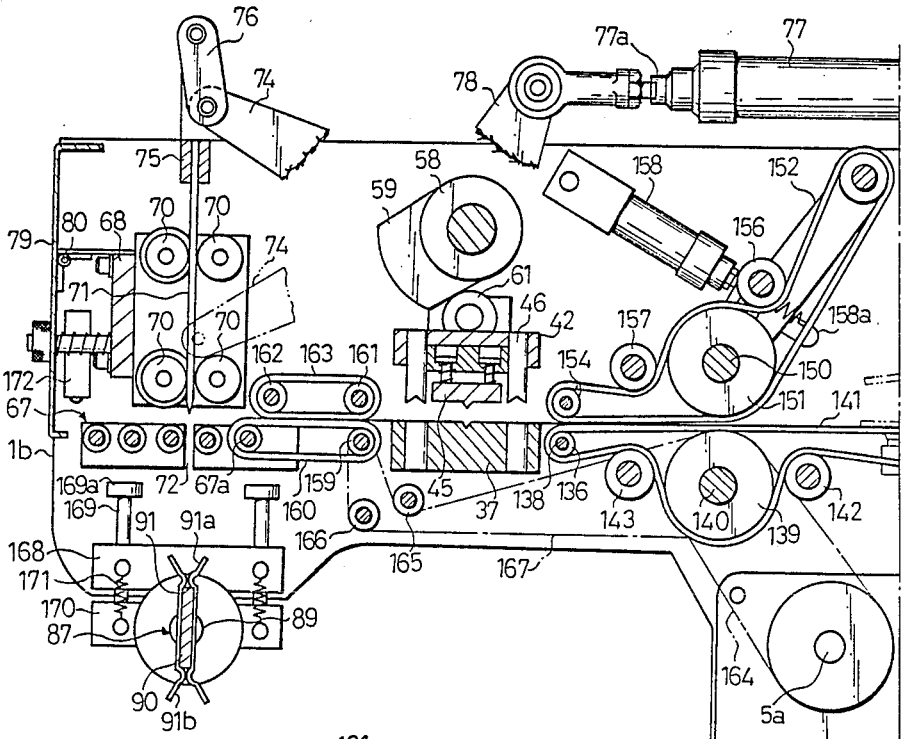
FIG. 9c
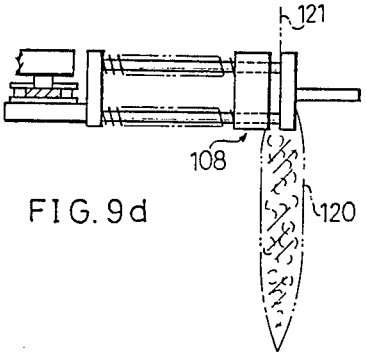
FIG. 9d

BAG COVERING APPARATUS

FIELD OF THE INVENTION

The present invention relates to a covering apparatus in a bagging and wrapping machine, that provides a cover for bags by folding said cover in two and sealing it on the opening of the bag.

DESCRIPTION OF THE RELATED ART

In bag covering devices providing a cover at the opening of a bag in bagging and wrapping machines, generally, the two processes of folding the cover in two and positioning both ends of the twice folded cover on both sides of the opening of the bag are done separately. Due to this, a decrease in work efficiency arises.

SUMMARY OF THE INVENTION

The objective of the present invention is to provide a bag covering apparatus in which the work efficiency is improved by enabling the simultaneous performance of the process of folding the cover in two and the process of positioning both end portions of the twice folded cover on both sides of the opening of the bag.

In order to realize the objective mentioned above, in the present invention, the twice folded cover bears a folding portion, and this cover is placed by the bag covering apparatus on the opening of the bag. A bag covering apparatus is provided, comprising a folding means operationally capable of folding the cover in two at the folding portion, a cover retaining means provided near the folding means, having at least two holding portions capable of holding the folding portion of the cover, and a linking means functionally connected to the cover retaining means, making the opening of the bag and the holding parts of the cover retaining means facing the opening of the bag approach each other in accordance with the operation of the folding means, thereby positioning the cover on the opening of the bag. The folding portion of the cover becomes inserted into the holding portions of the cover retaining means with the action of the folding means. The cover retaining means is movable such that when one of the holding portions faces the opening of the bag, the other holding portion faces the folding means.

Other objects of the present invention will become clear with an understanding of the embodiments described later, and as specified in the appended claims. Further, many advantages not mentioned in this specification will become apparent to one skilled in the art upon application of the present invention.

BRIEF DESCRIPTION OF THE DRAWINGS

FIG. 1(*a*) and FIG. 1(*b*) are sectional views showing the bag covering apparatus;

DESCRIPTION OF THE PREFERRED EMBODIMENTS

[First Embodiment]

Figure 8:
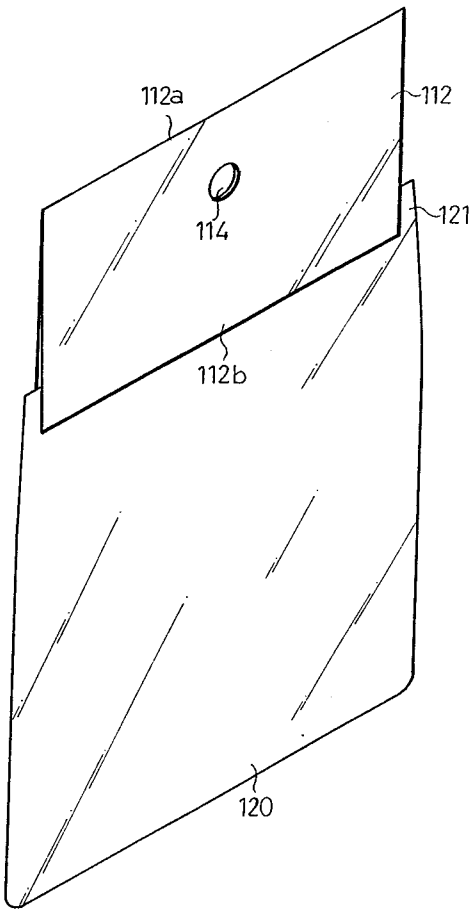
FIG. 8 is a perspective view showing a bag with a cover on it.

The first embodiment of the present invention is described below, with reference to FIG. 1 (*a*) to FIG. 8.

Figure 1D:
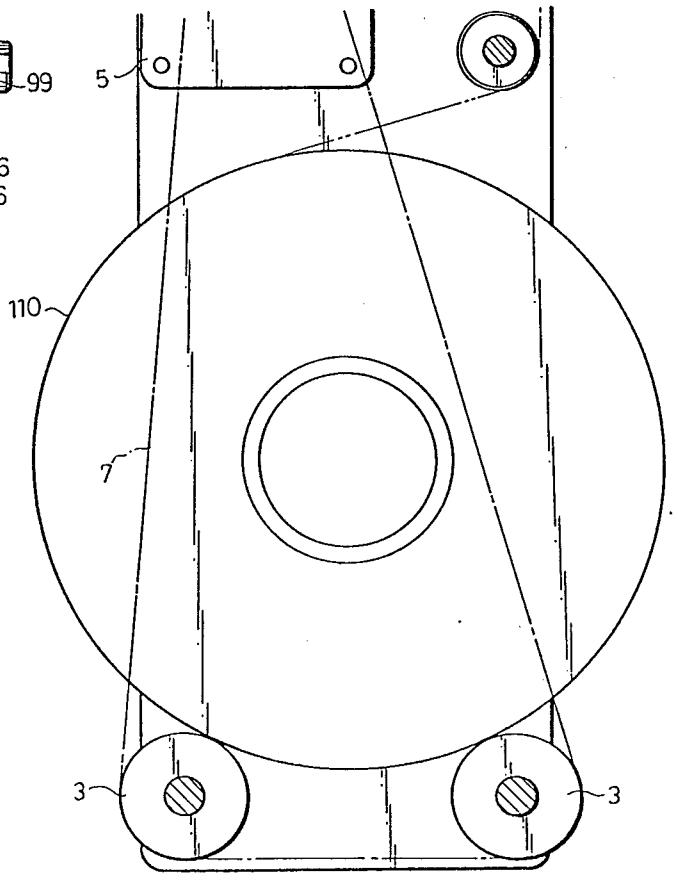
FIG. 1(*a*) to FIG. 8 show the first embodiment of the present invention.
Figure 1B:
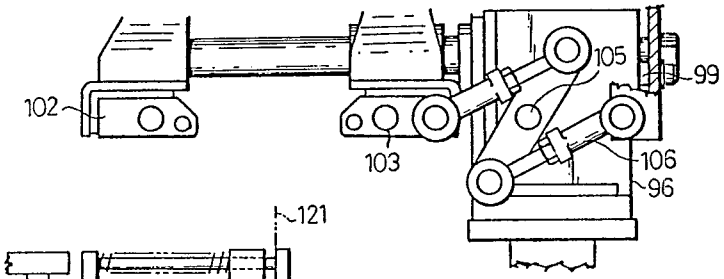
Figure 1C:
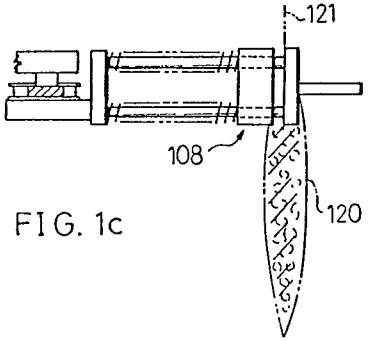
Figure 4:
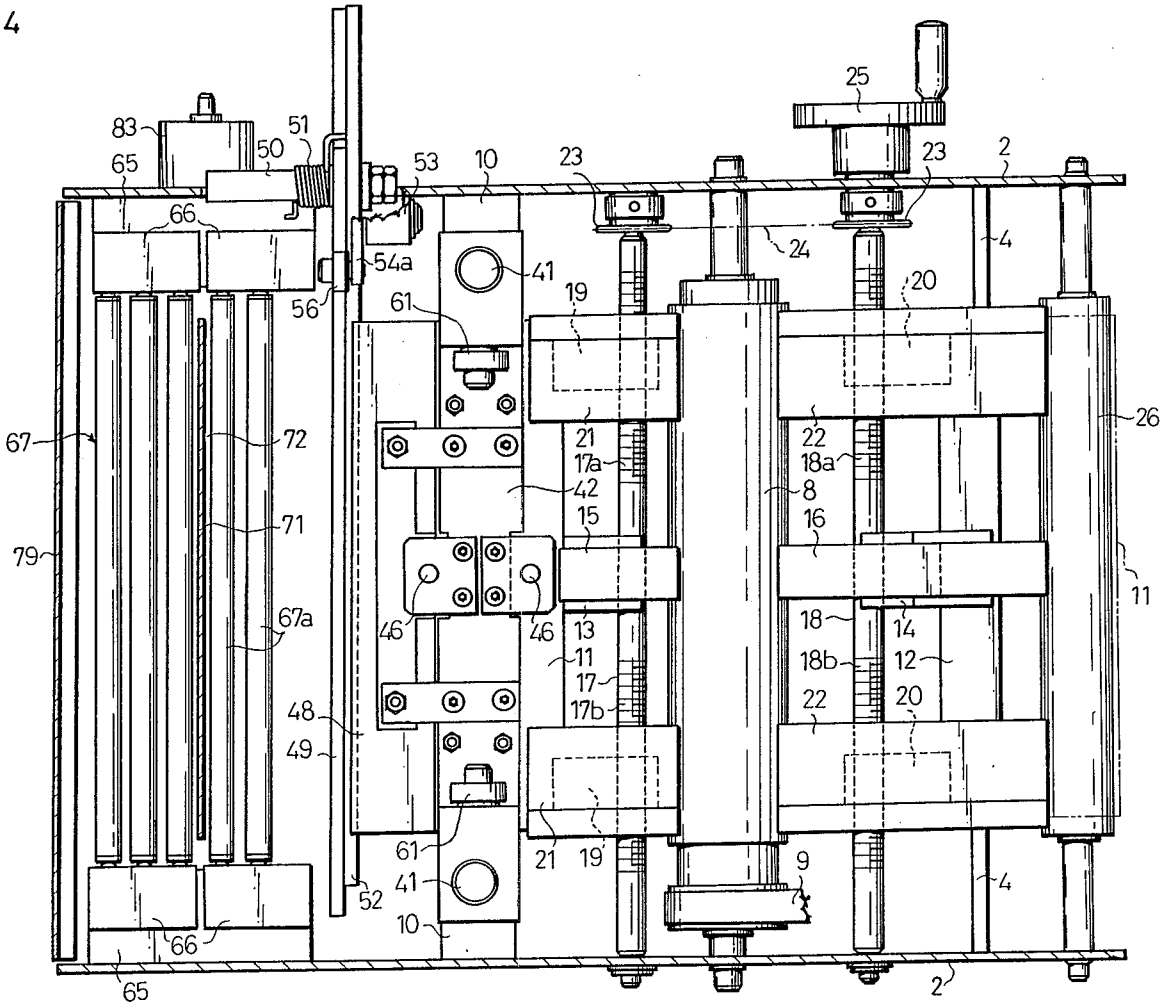
FIG. 4 is a sectional view along the line IV—IV in FIG. 1(*a*)

As shown in FIG. 1(*a*), 1(*b*) and FIG. 4, a pair of support rollers 3 are supported between the lower portions of the left and right side frames 2 at the side 1*a* of the machine frame 1 from which a cover is brought in. A cover roll 110, which is a roll of a long strip of cover 111 made of thick paper having its inner surface applied with a heat-melting adhesive, and serving as a cover containing means, is supported on both of these rollers 3. Above this cover roll 110, an electric-powered motor 5 is installed on a support plate 4 spanning the distance between the side frames 2. A driving pulley 6 is fixed to the output shaft 5a of the motor 5, and a belt 7 is fitted between this driving pulley 6 and the support rollers 3. Above the electric-powered motor 5, a feeding roller 8 is supported between the side frames 2. A belt 9 is fitted between this feeding roller 8 and the driving pulley 6.

On the front and back sides of the feeding roller 8, mounting plates 11, 12 are attached to a support plate 10 spanning the distance between the side frames 2 and to the support plate 4. At the central portion between the side frames 2, mounting plates 13, 14 are attached to these mounting plates 11, 12. Central cover support plates 15, 16 are fixed to the mounting plates 13, 14. Below these cover support plates 15, 16, bolts 17, 18 are rotatably supported between the side frames 2. Threaded portions 17*a*, 17*b*, 18*a*, 18*b* are formed near the left and right ends of these bolts 17, 18. The threads of the threaded portions 17*a*, 18*a* on one side are in the reverse direction of those of the threaded portions 17*b*, 18*b* on the other side. These threaded portions 17*a*, 17*b*, 18*a*, 18*b* are respectively fitted with nuts 19, 20. The end portions of the nuts 19, 20 are supported by the mounting plates 11, 12 such that they are movable in the left and right directions. Left and right cover support plates 21, 22 are fixed to the top portion of the nuts 19, 20. On the inner surface on one of the side frames 2, sprockets 23 are attached to the ends of the bolts 17, 18. A chain 24 is fitted between these sprockets 23. On the outer surface of the same side frame 2, a handle 25 is attached to an end of the bolt 18. When this handle 25 is rotated, the bolts 17, 18 rotate, and the left and right cover support plates 21, 22 move toward and apart from the central cover support plates 15, 16.

At the side 1(*a*) of the machine from which the cover is brought in, a pair of upper and lower guide rollers 26, 27 are supported between the side frames 2. The long strip of cover 111 drawn from the cover roll 110 is laid on the cover support plates 15, 16, 21, 22 and on the feeding roller 8 via the guide rollers 26, 27.

Figure 3:
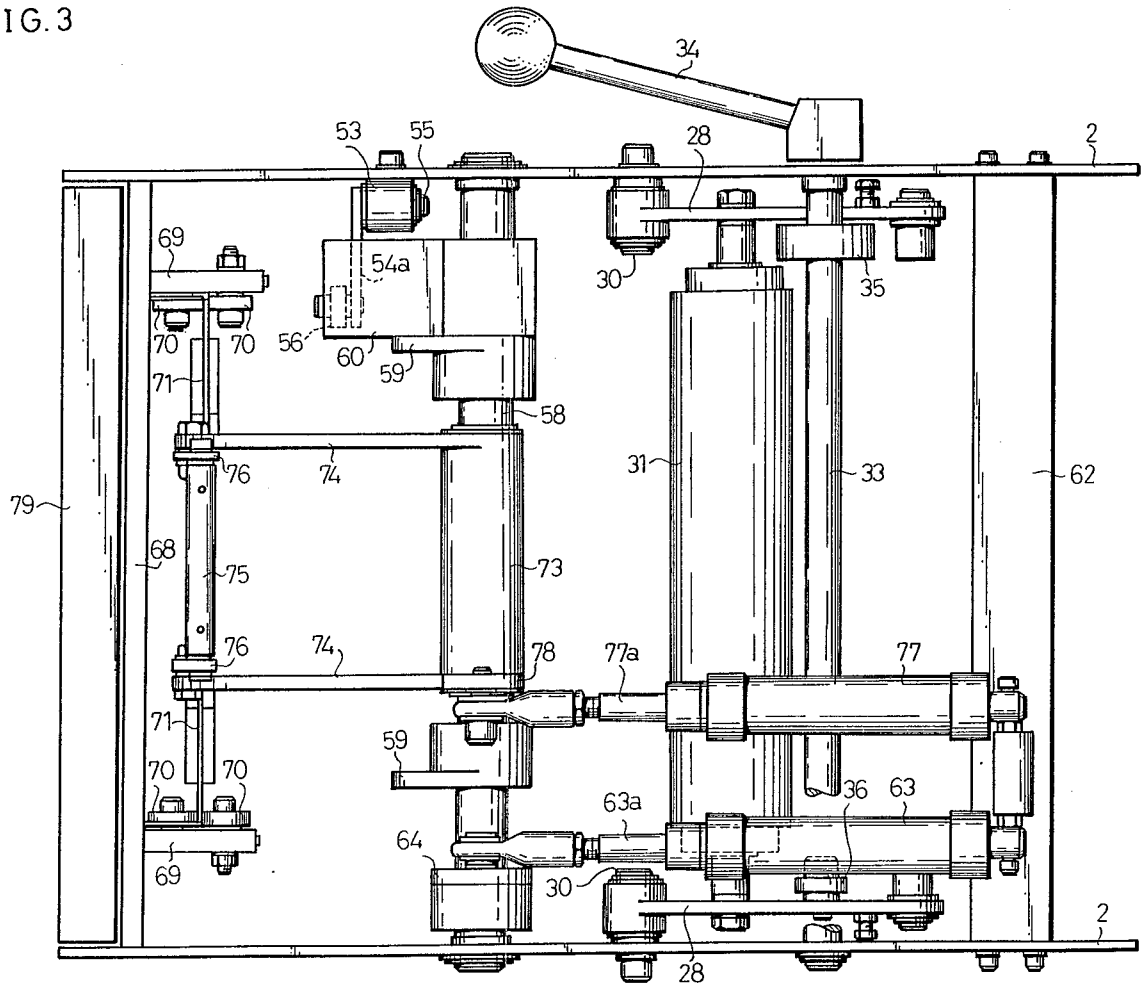
FIG. 3 is a sectional view along the line III—III in FIG. 1(*a*)

As shown in FIG. 1(*a*), 1(*b*) and FIG. 3, above the feeding roller 8, two pairs of upper and lower connecting levers 28, 29 are supported on the inner surfaces of the side frames 2 such that they are rotatable upward and downward about the axes 30. A pressing roller 31 enabled to make contact with the feeding roller 8 is supported between the lower connecting levers 29. Compression coil springs 32 are interposed between the front ends of the pairs of upper and lower connecting levers 28, 29. Above the connecting levers 28, 29, a cam shaft 33 is rotatably supported between the side frames 2. At the outer side of one of the side frames 2, an operating lever 34 is attached to an end of this cam shaft 33. At the inner sides of the side frames 2, cam plates 35 are attached to both ends of the cam shaft 33. The cam plates 35 are in contact with cam rollers 36 attached to the upper connecting levers 28. When the cam rollers 36 are pressed downward by the cam plates 35, the pressing roller 31 is pressed against the feeding roller 8 due to the elastic forces of the compression coil springs 32. The feeding means, which feeds the long strip of cover 111, is made up of the feeding roller 8 and the pressing roller 31.

Figure 2:
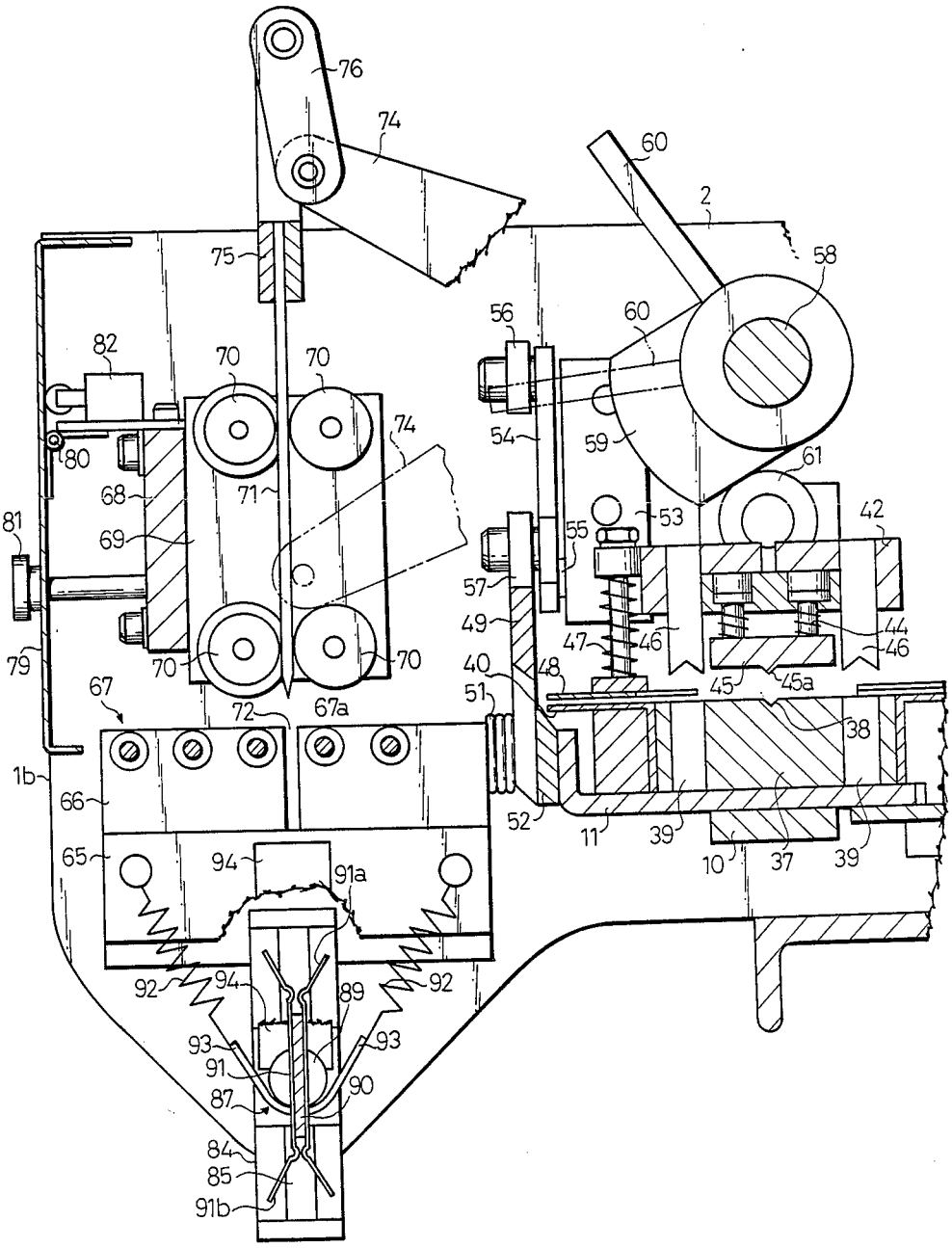
FIG. 2 is an enlarged partial sectional view of FIG. 1(*a*) and FIG. 1(*b*)
Figure 5:
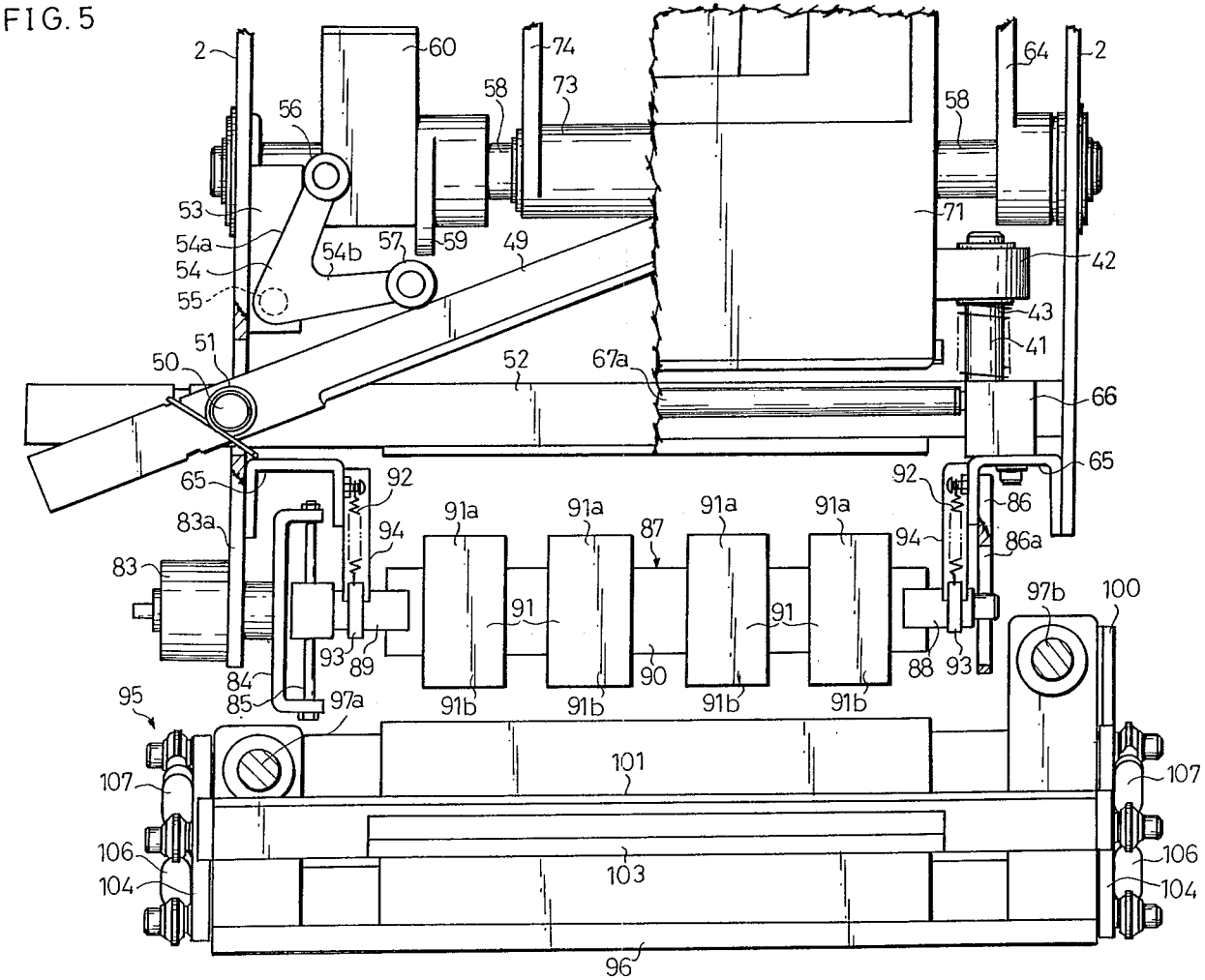
FIG. 5 is a partially broken left side view of FIG. 1(*a*) and FIG. 1(*b*)
Figure 6A:
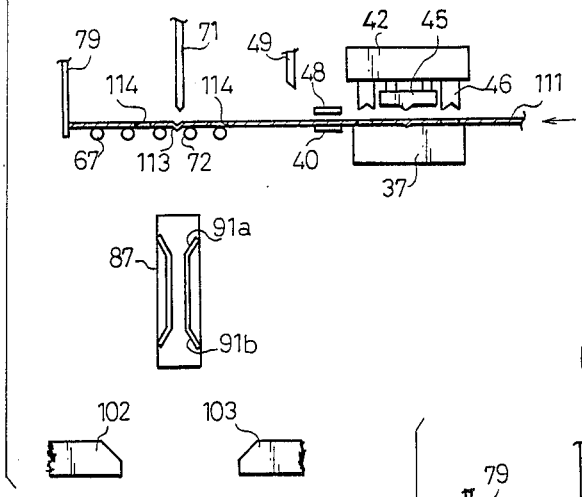
FIGS. 6(*a*)-6(*l*) are simplified front views showing the operation of the present apparatus.
Figure 6B:
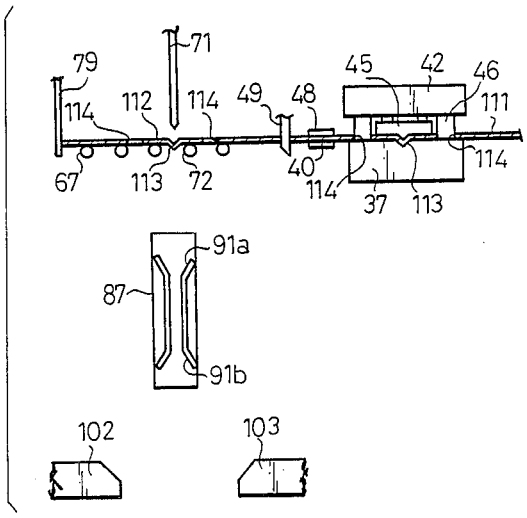
Figure 6C:
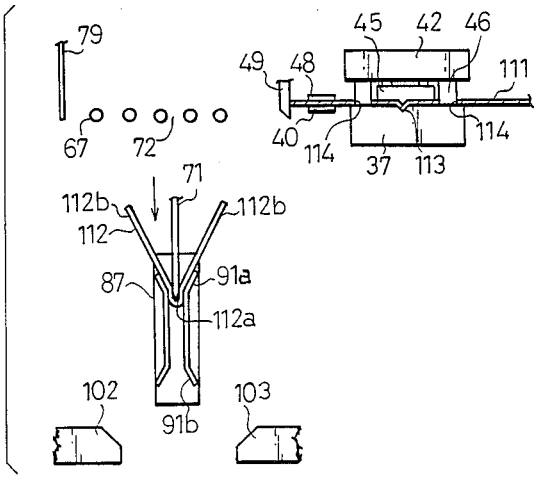
Figure 6D:
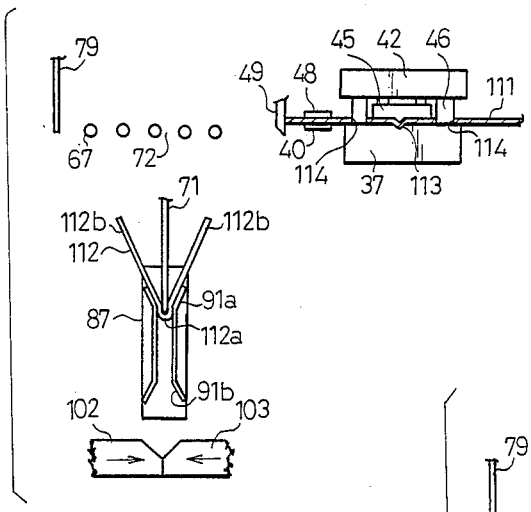
Figure 6E:
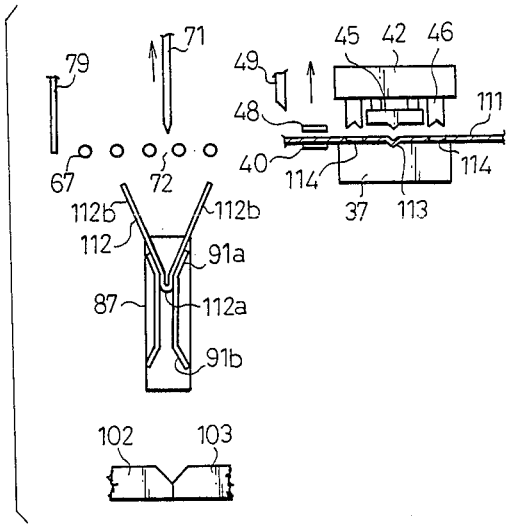
Figure 6F:
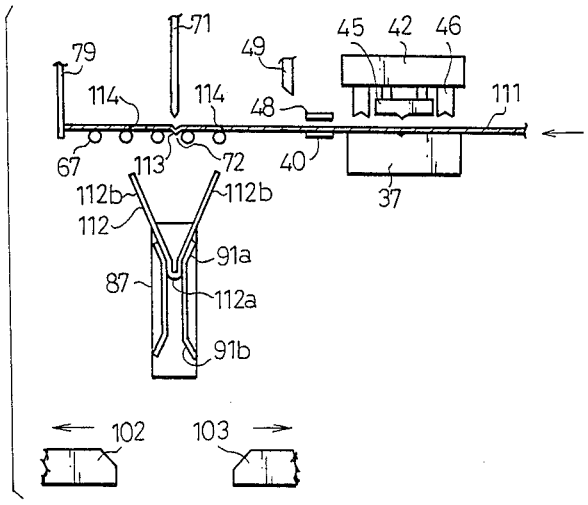
Figure 6G:
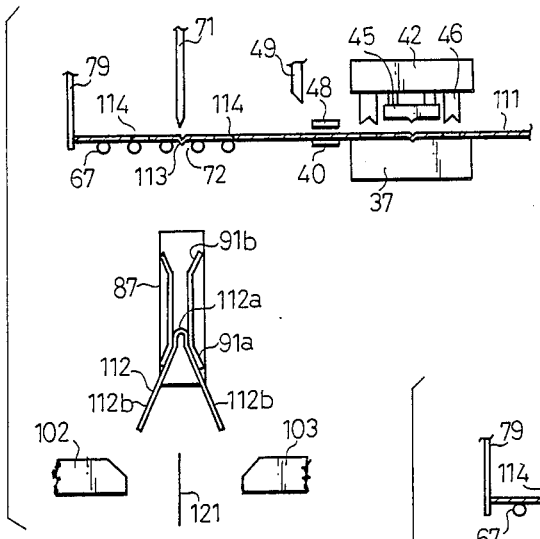
Figure 6H:
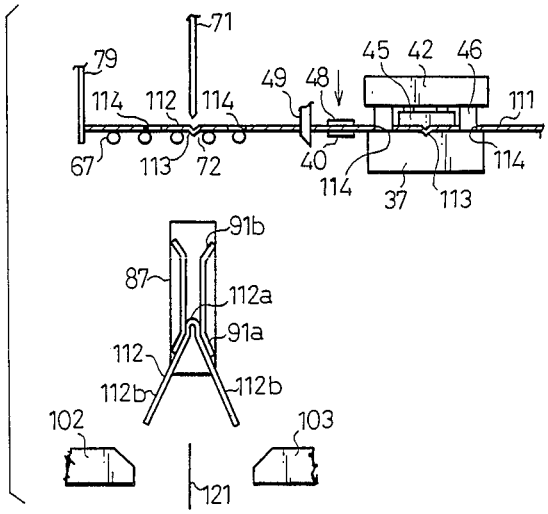
Figure 6I:
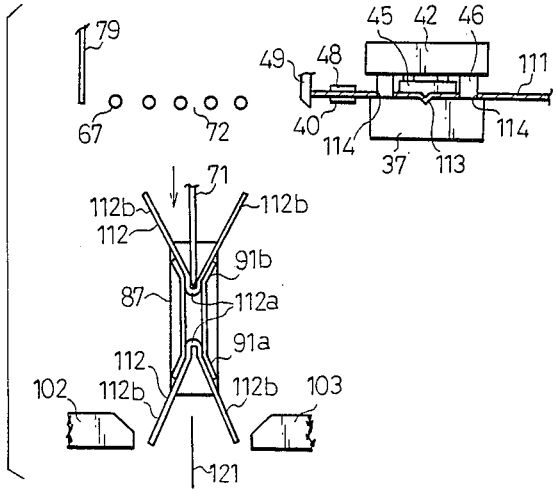
Figure 6J:
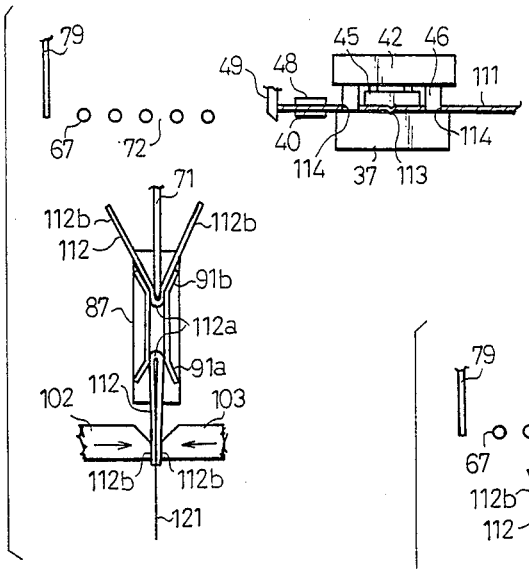
Figure 6K:
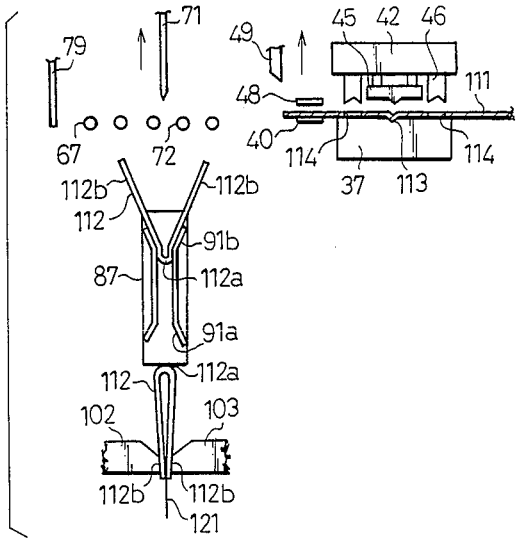
Figure 6L:
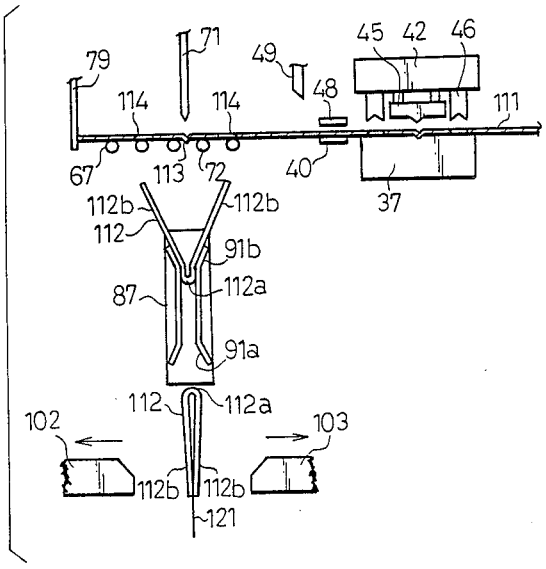

As shown in FIGS. 1(*a*), 1(*b*), FIG. 2, FIG. 4, and FIG. 5, beyond the pressing roller 8 at the side 1*b* where the cover is carried out, a fixed pressing platform 37 is attached on top of the mounting plate 11, and spans the distance between the side frames 2. A folding groove 38, extending from left to right, is formed on the upper surface of the fixed pressing platform 37. Punch insertion holes 29 are formed in front of and behind this folding groove 38. Also, beyond this fixed pressing platform 37 at the side 1*b* where the cover is carried out, a fixed holding plate 40 is attached on top of the mounting plate 11. Support shafts 41 are provided at both ends of the fixed pressing platform 37, perpendicular to it. Above the fixed pressing platform 37, a movable platform 42 is supported at its ends by the support shafts 41 such that it is movable upward and downward. Between the fixed pressing platform 37 and the movable platform 42, compression coil springs 43 are would around the outer circumference of the support shafts 41. On the lower surface of the movable platform 42, a pressing plate 45, forced downward by compression coil springs 44, is supported such that it is movable upward and downward. A protruding portion 45*a*, corresponding to the folding groove 38 on the fixed pressing platform 37, is formed on the lower surface of the pressing plate 45. The notch forming means, which forms a folding line on the long strip of cover 111, is made up of the folding groove 38 and this protruding portion 45*a*. In front of and behind the pressing plate 45, punches 46, corresponding to the punch insertion holes 39 of the fixed pressing platform 37, are attached to the lower surface of the movable platform 42. Above the fixed holding plate 40 of the fixed pressing platform 37, a movable holding plate 48, forced downward by a compression coil spring 47, is supported such that it is movable upward and downward.

Beyond the holding plates 40, 48 at the side 1*b* where the cover is carried out, a movable blade 49 is supported on one of the side frames 2 such that it is rotatable upward and downward about an axis 50. The movable blade 49 is always pushed upward by means of a torsion coil spring 51 wound around this axis 50. This movable blade 49 extends up to near the vicinity of the other side frame 2, and is such that it makes sliding contact with a fixed blade 52 attached to the mounting plate 11. The cutting means, which cuts the long strip of cover 111, is made up of the movable blade 49 and the fixed blade 52. Above the axis 50 which supports the movable blade 49, on a mounting block 53 attached to one of the side frames 2, a fork-shaped connecting lever 54 is supported such that it is rotatable upward and downward about an axis 55. Pressing rollers 56, 57 are attached to the front end portions of the upper and lower arms 54*a*, 54*b* of the connecting lever 54. One of the pressing rollers 57 is in contact with the top portion of the movable blade 49.

Figure 7A:
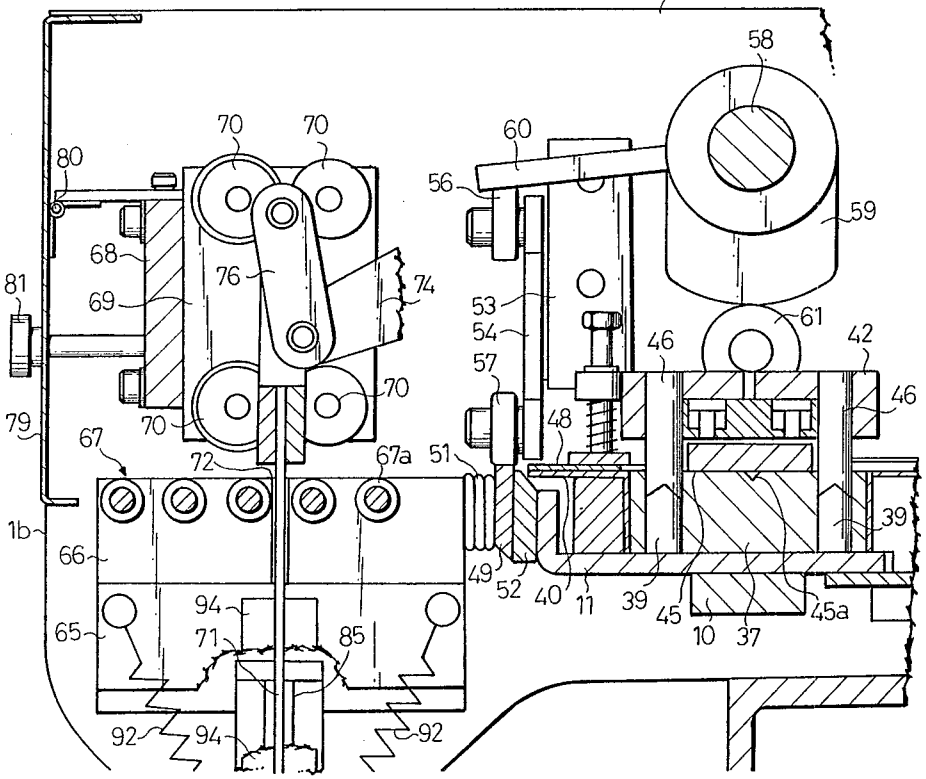
FIG. 7(*a*) and FIG. 7(*b*) are enlarged sectional views showing FIG. 6(*d*) or FIG. 6(*j*) in detail.
Figures 7B, 7C:
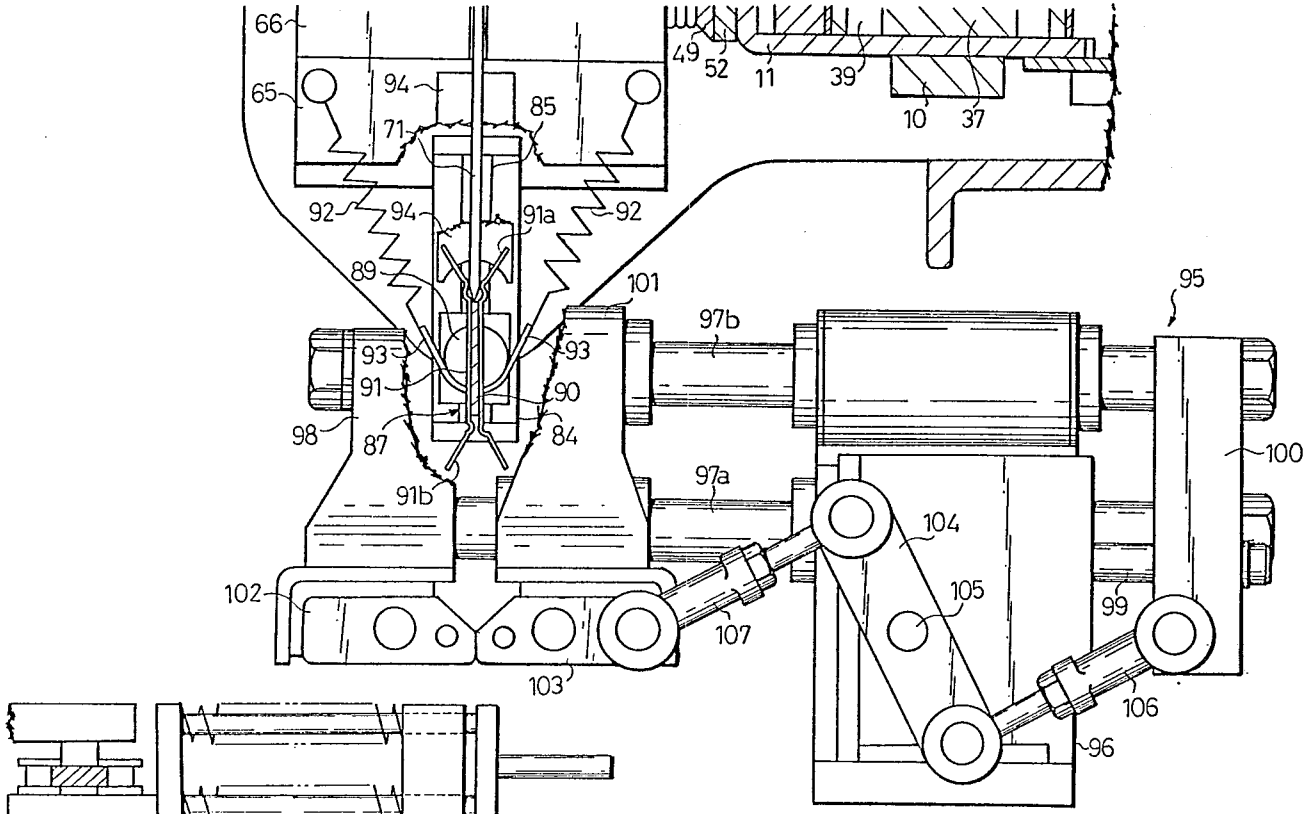

As shown in FIG. 1(*a*) to FIG. 3 and FIG. 5, above the movable platform 42, a rotatable shaft 58 is supported between the side frames 2. Movable platform pressing levers 59 are attached to the left and right sides of this rotatable shaft 58. A movable blade pressing lever 60 is attached to one side of the rotatable lever 58. As the rotatable shaft 58 rotates, both of the movable platform pressing levers 59 push the pressing rollers 61 attached to the left and right sides of the movable platform 42. Also, the movable blade pressing lever 60 is caused to push the pressing roller 56 of the connecting lever 54. The linking means, which connects the protruding portion 45a of the pressing plate 45 and the movable blade 49 such that they are enabled to operate simultaneously, is made up of the connecting lever 54, the movable platform pressing levers 59, the movable pressing lever 60 and the pressing rollers 61. At the side 1*a* from which the cover is brought in, an air cylinder 63 is mounted on a support plate 62 spanning the distance between the upper end portions of the side frames 2. The piston rod 63*a* of the air cylinder 63 is connected to one side of the rotatable shaft 58 via a connecting plate 64. When this piston rod 63*a* protrudes, the rotatable shaft 58 rotates. Then, first, the movable platform pressing levers 59 push the pressing rollers 61 of the movable platform 42, and the movable platform 42 moves downward against the elastic force of the compression coil spring 43. Next, the movable blade pressing lever 60 pushes the pressing roller 56 of the connecting lever 54, and the movable blade 49 is pushed by the pressing roller 57 of the connecting lever 54 and is moved downward against the elastic force of the torsion coil spring 51. As shown in FIG. 7(*a*) and FIG. 7(*b*), when the movable platform 42 is pushed downward, first, the movable holding plate 48 is pressed against the fixed holding plate 40. Then, the pressing plate 45 is pressed against the surface of the fixed pressing plate platform 37 and the protruding portion 45*a* of the pressing plate 45 engages with the folding groove 38 of the fixed pressing platform 37. At the same time, both punches 46 of the movable platform 42 becomes inserted into the punch insertion holes 39 of the fixed pressing platform 37. Also, when the movable blade 49 is pressed downward, the movable blades 49, starting from the side of its central axis of rotation, gradually makes sliding contact with the fixed blade 52.

As shown in FIG. 1(*a*) to FIG. 5, at the side 1*b* of the machine frame 1 where the cover is carried out, support blocks 66 are attached on top of brackets 65 fixed to the inner surfaces of the side frames 2. A plurality of support rollers 67*a* making up the cover receiving platform 67, is provided parallel to each other between the support blocks 66.

Above the cover receiving platform 67, a support plate 68 is provided, spanning the distance between the sides frames 2. Four guide rollers 70 are mounted on each of mounting plates 69 fixed to the left and right sides of the support plate 68. Between each of these sets of guide rollers 70, a folding plate 71, serving as a folding piece, is held such that it is movable upward and downward in a perpendicular position. Among the intervals between the support rollers 67*a* of the cover receiving platform 67, the one that is directly below the lower end portion of the folding plate 71 is a cover pushing hole 72. The folding means is made up of the folding plate 71 and the cover pushing hole 72.

A rotatable cylinder 73 is rotatably fitted to the rotatable shaft 58 at the middle portion of the rotatable shaft 58. Connecting levers 74 are fixed to the left and right sides of the rotatable cylinder 73. A reinforcing plate 75 is attached to the upper end of the folding plate 71. On the left and right sides of this reinforcing plate 75, the connecting levers 74 are connected via connecting links 76. An air cylinder 77 is mounted on the support plate 62 located at the side 1*a* from which the cover is brought in. The piston rod 77*a* of the air cylinder 77 is connected to one side of the rotatable cylinder 73 via a connecting plate 78. When this piston rod 77*a* makes a reciprocating motion, the folding plate 71, via the connecting plate 78, rotatable cylinder 73, connecting levers 74, and connecting links 76, moves upward and downward, passing through the cover pushing hole 72.

Beyond the cover receiving platform 67 at the side 1*b* where the cover is carried out, a stopper plate 79 is supported by the support plate 68 through hinges 80 such that the stopper 79 can be tilted forward and backward. The tilting position of the stopper plate 79 is regulated by the contact of a pin 81, attached to the stopper plate 79, with the support plate 68. A limit switch 82 is attached to the top portion of the support plate 68. When the stopper plate 79 is tilted by the end portion of the long strip of cover 111 being carried on the cover receiving platform 67, the limit switch 82 becomes turned on by the stopper plate 79. When the limit switch 82 is turned on, the electric-powered motor 5 is turned off and conveyance of the long strip of cover 11 is stopped.

Below the cover receiving platform 67, a rotary solenoid 83, serving as a rotating means, is attached on the outer side of one of the side frames 2. At the inner side of the side frame 2, a support piece 84, having the shape of the cross section of the gutter, is fixed to a rotary shaft 83*a* of the rotary solenoid 83. A support shaft 85 is further attached to this support piece 84. At the inner side of the other side frame 2, a bearing plate 86 is fixed to the brackets 65. An elongated hole 86*a* extending perpendicularly is formed on this bearing plate 86. Between this elongated hole 86*a* and the support shaft 85, the terminal axial portions 88, 89 of a cover retaining piece 87, serving as a cover retaining means, are supported such that they are movable upward and downward. The movement sustaining means, which allows the upward and downward movements of the cover retaining piece 87, is made up of the support shaft 85, the bearing plate 86 and the elongated hole 86*a*. In the cover retaining piece 87, a base 90 spans the distance between the axial portions 88, 89. Four pairs of holding plates 91 are provided in parallel on the base 90. Holding portions 91*a*, 91*b*, having a wide V shape, are formed on the upper and lower portions of each holding plate 91. As shown in FIG. 2, above the terminal axial portions 88, 89 of the cover retaining piece 87, the ends of a pair of extension coil springs 92, serving as a forcing means, are supported by the brackets 65. A pliable band 93, on which the axial portions 88, 89 are placed, is connected between the front end portions of the extension coil springs 92. The linking means, which makes the cover retaining piece 87 move upward and downward with the movement of the folding plate 71, is made up of the movement sustaining means 85, 86, 86*a*, the terminal axial portions 88, 89, the base 90, the extension coil springs 92, and the pliable band 93. Stopper shields 94 are fixed to both brackets 65. The axial portions 88, 89, which are raised by the extension coil springs 92, are in contact with the lower end portions of these stopper shields 94. The rotary shaft 83*a* of the rotary solenoid 83 makes a reciprocating rotary motion within a range of 180 degrees. With the rotation of the rotary solenoid 83, one of the holding portions 91*a*, 91*b* of the cover retaining piece 87 corresponds with the cover pushing hole 72 of the cover receiving platform 67. Also, the other of holding portions 91*a*, 91*b* corresponds with the bag opening 121 to be described later. As shown in FIGS. 7(*a*) and 7(*b*), when the folding plate 71 moves downward and passes through the cover pushing hole 72 of the cover receiving platform 67, the lower end portion of the folding plate 71 becomes inserted into one of the holding portions 91*a*, 91*b* of the cover retaining piece 87 corresponding to the cover pushing hole 72. Then, the cover retaining piece 87 is pushed downward against the elastic force of the extension coil springs 92 by means of the lower end portion of the folding plate 71.

As shown in FIGS. 1(*a*), 1(*b*) and FIG. 5, a sealing mechanism 95 is provided below the cover retaining piece 87. In this sealing mechanism 95, below the side frames 2, sliding shafts 97*a*, 97*b* are supported on both sides of a bearing portion 96 such that these sliding shafts 97*a*, 97*b* are movable forward and backward. A heater mounting portion 98 is provided at one ends of the sliding shafts 97*a*, 97*b*. An air cylinder (not shown) is attached on top of the bearing portion 96. The piston rod 99 of this air cylinder and the other ends of the sliding shafts 97*a*, 97*b* are connected by means of a connecting plate 100. Between the bearing portion 96 and the heater mounting portion 98, and between the sliding shafts 97*a*, 97*b*, a heater mounting portion 101 is supported such that it is movable in the axial direction of the sliding shafts 97*a*, 97*b*. Heating plates 102, 103, serving as sealing pieces, are attached to the lower surfaces of the heater mounting portions 98, 101. On the left and right sides of the bearing portion 96, connecting levers 104 are supported such that they are rotatable about an axis 105. Connecting links 106, 107 are connected between both ends of the connecting levers 104 and the connecting plate 100 and the heater mounting portion 101. When the piston rod 99 of the air cylinder makes a reciprocating motion, one of the heater mounting portions 98, moves in the direction of motion of the piston rod 99. The other heater mounting plate 101 moves in the reverse of the direction of motion of the piston rod 99 via the connecting plate 100, connecting links 106, connecting levers 104 and connecting links 107. As a result, the heating plates 102, 103 move toward and apart from each other.

A clamp 108 rests below the interval between the heating plates 102, 103, grasping the bag opening 121 of a bag 120 containing a commodity.

Next, the operation of the present device constructed as above is explained.

In the state shown in FIG. 1, the pressing plate 45, punches 46, movable holding plate 48, folding plate 71 and the cover retaining piece 87 are all in their raised positions. First, before operating the device, the long strip of cover 111 drawn from the cover roll 110 is set according to the next procedure. The operating lever 34 is rotated to release the pressure of the pressing roller 31 on the feeding roller 8. Also, the operating handle 25 is rotated to adjust the interval between the left and right cover support plates 21, 22 such that it conforms with the width of the long strip of cover 111. Then the long strip of cover 111 is set on the cover support plates 15, 16, 21, 22 via the guide rollers 26, 27. Further, the long strip of cover 111, passing over the fixed pressing platform 37, the fixed holding plate 40, and the fixed blade 52, and below the punches 46, pressing plate 45, movable holding plate 48 and movable blade 49, is set on top of the support rollers 67*a* of the cover receiving platform 67, making the end portion of the long strip of cover 111 come in contact with the stopper plate 79. Alternatively, it can be positioned just in front of the stopper plate 79. Afterward, the operating lever 34 is rotated, causing the long strip of cover 111 on the feeding roller 8 to be pressed by the pressing rollers 31.

When the device is operated in this state where the cover is set, the electric-powered motor 5 is driven and the support rollers 3 and the feeding roller 8 rotate. As a result, while the cover roll 110 is being rotated, the long strip of cover 111 is fed toward the side 1*b* where the cover is carried out. The end portion of the long strip of cover 111 comes in contact with the stopper plate 79 and pushes the stopper plate 79. When the stopper plate 79 is tilted due to this contact and consequent pressure on it, the limit switch 82 becomes turned on, the electric-powered motor 5 is stopped, and conveyance of the long strip of cover 111 is halted.

In this state, when the movable platform 42 moves downward, first, the long strip of cover 111 is held between the fixed holding plate 40 and the movable holding plate 48. Immediately afterward, a folding line is impressed on the long strip of cover 111 by means of the protruding portion 45*a* of the pressuring plate 45 and the folding groove 38 of the fixed pressing platform 37. At the same time, holes are formed on the long strip of cover 111 in front of and behind the folding line by means of the punches 46. Immediately after this, the movable blade 49 is pushed downward, cutting the long strip of cover 111 by means of this movable blade 49 and the fixed blade 52.

At the first try, a part of the cover, cut and left on the cover receiving platform 67 does not have the folding line and punch holes mentioned earlier. After the cutting, the long strip of cover 111 left on the fixed pressing platform 37 is carried toward the cover receiving platform 67, as shown in FIG. 6(*a*).

In the state shown in FIG. 6(*b*), as mentioned earlier, a folding line 113 and punch holes 114 are formed on the long strip of cover 111. At the same time, the long strip of cover 111 is cut and a cover 112 having the folding line 113 and punch holes 114 formed on it is left on the cover receiving platform 67.

In this state, as shown in FIG. 6(*c*), when the folding plate 71 moves downward, its lower end portion comes in contact with the folding line 113 of the cover 112 on the cover receiving platform 67. Then, the folding line 113 is pushed downward by the folding plate 71 into the cover pushing hole 72, and the folded portion 112*a* of the cover 112 folded in two becomes inserted into the holding portions 91*a* of the cover retaining piece 87. Simultaneously with this, the cover retaining piece 87 is pushed downward by the folding plate 71.

Since the cover is not yet contained in the other holding portion 91*b*, the sealing mechanism 95 remains idle, as shown in FIG. 6(*d*), 6(*e*) and FIG. 6(*f*).

During the sealing process, the pressing plate 45, punches 46, movable holding plate 48 and movable blade 49 move upward, as shown in FIG. 6(*e*). Then, without the cover 112 on the cover receiving platform 67, the long strip of cover 111 having a folding line 113 and punch holes 114 formed on it is on standby on the fixed pressing platform 37. During this time, the cover retaining piece 87 moves upward due to the elastic force of the extension coil springs 92.

Then, as shown in FIG. 6(*f*), this long strip of cover 111 is carried toward the cover receiving platform 67.

Afterward, as shown in FIG. 6(*g*), the rotary shaft 83*a* of the rotary solenoid 83 turns 180 degrees in the reverse direction, and the twice folded cover 112 contained in one of the holding portions 91*a* of the cover retaining piece 87 becomes positioned toward the bag opening 121.

Next, as shown in FIGS. 6(*h*), 6(*i*), cutting of the long strip of cover 111, having the folding line 113 and punch holes 114 formed on it, and consequent folding in two of the cover 112 are performed in regular succession. These operations are the same as those described for FIG. 6(*b*) and 6(*c*).

As shown in FIG. 6(*i*), in the cover retaining piece 87 which has been pushed downward by the folding plate 71, a cover 112 is contained in each of both holding portions 91*a*, 91*b*. The end portions 112*b* of the cover 112 corresponding to the sealing mechanism 95 are positioned on both sides of the bag opening 121. Then, as shown in FIG. 6(*j*), both heating plates 102, 103 approach each other, and when the bag opening 121 together with the ends 112*b* of the cover 112 on both sides of the bag opening 121 are sandwiched by these heating plates 102, 103, the adhesive applied on the inner surface of the cover 112 is melted, and the cover 112 is pasted to the bag opening 121.

After this, as shown in FIG. 6(*k*), the pressing plate 45, punches 46, movable holding plate 48, movable blade 49 and folding plate 71 move upward in the same manner described for FIG. 6(*e*). During this time, the cover retaining piece 87 moves upward due to the elastic force of the extension coil springs 92, and the cover 112 is released from the holding portion 91*a*.

Then, as shown in FIG. 6(*l*), when the heating plates 102, 103 move apart from each other, the clamp 108 grasping the bag 120 having the cover 112 pasted to this opening 121 moves away from the sealing mechanism and proceeds to perform the next process. At the same time, the bag 120 is released from the grasp of the clamp 108, discharged, and becomes a bagged commodity, as shown in FIG. 8. Simultaneous with the discharge of the bagged commodity, conveyance of the long strip of cover 111 continues in the same manner described for FIG. 6(*f*).

Next, the direction of the cover retaining piece 87 is reversed and returns to the state similar to the one shown in FIG. 6(*g*). From here, the operation of the device continues, by repetition of the procedures described above.

[Second Embodiment]

Figure 9B:
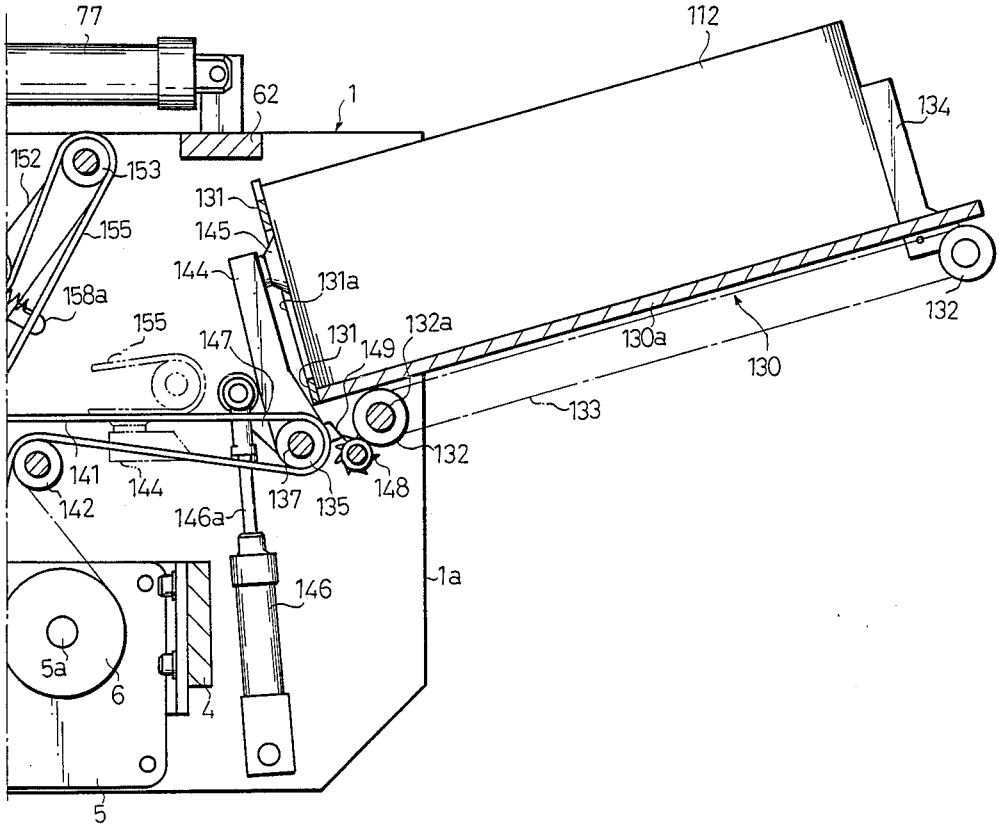
FIG. 9(*a*) and FIG. 9(*b*) are sectional views showing the bag covering apparatus of the second embodiment of the present invention.

Next, the second embodiment of the present invention is described with reference to FIG. 9(*a*) and FIG. 9(*b*).

In the first embodiment, the long strip of cover 111 is drawn from the cover roll 110 then cut to obtain one piece of cover 112. However, in the second embodiment, pieces of cover 112 that have been cut beforehand are consecutively being carried toward the cover receiving platform 67. Therefore, the movable blade 49 and the fixed blade 52, as well as the fixed holding plate 40 and the movable holding plate 48 and parts related to these pieces are not present in the second embodiment.

The differences of the second embodiment with the first embodiment are described in detail below.

At the side 1*a* of the machine frame 1 from which the cover is brought in, a box-shaped cartridge 130, serving as a cover containing means, is provided on the machine frame. The bottom plate 130*a* of this cartridge tilts downward from the outer side of the machine frame 1 toward the inner side. Inside the cartridge 130, a plurality of covers 112, cut beforehand to a prescribed size, are arranged upright on the bottom plate 130*a*. These covers 112 are successively pressed against a stopper 131 formed at the four front end corners of the cartridge 130. A pair of pulleys 132 are supported on the lower side of the bottom plate 130*a*. A belt 133 is fitted between these pulleys 132. An attachment 134 is connected ot the belt 133, extending upward from the bottom plate 130*a*. This attachment 134 can move toward or away from the stopper along the bottom plate 130*a* according to the rotation of the belt 133. Therefore, the plurality of covers 112 arranged upright on the bottom plate 130*a* are sandwiched between the stopper 131 and this attachment 134, and are pressed against the stopper 131 by this attachment 134.

Between the cartridge 130 and the fixed pressing platform 37 and adjacent to them, pulleys 135, 136 are supported on rotary shafts 137, 138 between the machine frames 1. Also, between the pulleys 135, 136, a pulley 139 is supported on a rotary shaft 140 between the machine frames 1. A plurality of round conveyor belts 141 are fitted between the pulleys 135, 136, 139 via the pulleys 142, 143.

A drawing arm 144 is fixed to the rotary shaft 137 adjacent to the cartridge 130. A suction disc 145 is attached to the front end of the drawing arm 144. The drawing means, which draws and retains the cover 112, is made up of the drawing arm 144 and the suction disc 145. Below this drawing arm 144, an air cylinder 146 is attached to the machine frame 1. The piston rod 146*a* of the air cylinder 146 is connected to the rotary shaft 137 via a link 147. When this piston rod 146*a* makes a reciprocating motion, the drawing arm 144 rotates about the rotary shaft 137 via the link 147. Further, the suction disc 145 of the drawing arm 144 is enabled to move between the drawing outlet 131*a* formed on the front end of the cartridge 130 and the round conveyor belt 141. Between the basal end portion of the drawing arm 144 and the pulleys 132 adjacent to it, a ratchet 148 with one-way clutch is supported on the machine frame 1. The ratchet 148 is linked to the rotary shaft 132*a* of the pulleys 132. The moving means, which moves the attachment 134 toward the stopper 131, is made up of the pulleys 132, belt 133, ratchet 148 and claw 149. The suction disc 145 of the drawing arm 144 draws a piece of cover 112 from the drawing outlet 131*a* of the cartridge 130, and when the drawing arm 144 rotates toward the round conveyor belt 141, the ratchet 148 is rotated by the protruding claw 149 provided on the basal end of the drawing arm 144, the belt 133 between the pulleys 132 is rotated, and the attachment 134 moves slightly toward the stopper 131, containing the covers 112 between it and the stopper 131.

Above the pulley 139, a pulley 151 linked to the pulley 139 is supported on the rotary shaft 150 between the machine frames 1. Tilting levers 152 rotatable toward the round conveyor belt 141 between the pulleys 135, 139 are supported on both ends of this rotary shaft 150. A pulley 153 is supported between the end portions of the tilting levers 152. Above the pulley 136 adjacent to the fixed pressing platform 37, a pulley 154 is supported between the machine frames 1. Between this pulley 154 and the pulleys 151, 153, a plurality of round conveyor belts 155 are fitted via pulleys 156, 157. Above the pulley 151, an air cylinder 158 is attached to the machine frame 1. The piston rod 158*a* of the air cylinder 158 is connected to the tilting levers 152. When this piston rod 158*a* makes a reciprocating motion, the tilting levers 152 rotate about the rotary shaft 150. The tilting levers 152 can be situated in either of two positions—the position where the upper round conveyor belt 155 lie on top of the lower round conveyor belt 141, or the position where the round conveyor belt 155 moves upward away from the round conveyor belt 141.

Between the fixed pressing platform 37 and the cover receiving platform 67, a plurality of round conveyor belts 160 are fitted between the pulley 159 supported between the machine frames 1 and adjacent to the fixed pressing platform 37 and the support rollers 67*a* of the cover receiving platform 67. Also, above these round conveyor belts 160, a pair of pulleys 161, 162 linked to the pulley 159 are supported between the machine frames 1. Between the pulleys 161, 162, an upper round conveyor belt 163 is fitted such that it is on top of the lower round conveyor belt 160. The feeding means, which feeds the cover 112 to the receiving platform 67, is made up of the upper and lower round conveyor belts 141, 155, 160, 163. The cover 112 sandwiched between the upper and lower round conveyor belts 155, 141 passes over the fixed pressing platform 37 and through the upper and lower round conveyor belts 163, 160, then carried toward the cover receiving platform 67.

The driving pulley 6 of the electric-powered motor 5 is connected to the pulley 139 by means of a belt 164. The pulley 139 is linked to the pulley 159 by means of a belt 167 via pulleys 165, 166.

Aside from the above, the second embodiment differs from the first embodiment specifically in the following points:

Below the cover receiving platform 67, a pair of guide shafts 169 are supported on a fixed block 168 attached to the machine frame 1 such that the guide shafts 169 are movable upward and downward. The movement sustaining means similar to the movement sustaining means of the first embodiment is made up of the guide shafts 169. Locking portions 169*a*, that make contact with the fixed block 168, are formed at the upper ends of the guide shafts 169. A pair of movable blocks 170 are attached to the lower ends of the guide plates 169. The movable blocks 170 are pushed upward by compression coil springs 171 serving as as pushing means. A cover retaining piece 87 similar to that of the first embodiment is rotatably supported between the movable blocks 170. The connecting means similar to the connecting means of the first embodiment is made up of the fixed block 168, guide shafts 169, movable blocks 170, and compression coil springs 171. The basic operations of these parts are the same as those of the first embodiment.

In the first embodiment, the cover 112 carried toward the cover receiving platform 67 is detected by means of the limit switch 82, but in the second embodiment, it is detected by means of a photoelectric switch 172.

Since the basic operation of the device of the second embodiment is similar to that of the first embodiment except for the conveyance of the cover 112, detailed explanation is given solely on the conveyance of the cover 112.

In the state where the upper round conveyor belt 155 is moving upward away from the lower round conveyor belt 141, the drawing arm 144 rotates upward and its suction disc 146 sucks a cover 112 from inside the cartridge 130. After this, the drawing arm 144 rotates downward with the cover 112 attached to it, and the cover 112 becomes placed on the lower round conveyor belt 141. Next, the tilting levers 152 rotated downward, and the cover 112 becomes sandwiched between the upper round conveyor belt 141 and the lower round conveyor belt 155. During this time, the sucking force of the drawing arm 144 is released. Then, when the round conveyor belts 141, 155, 160, 163 rotate, the cover 112 is carried toward the fixed pressing platform 37. After this, rotation of the round conveyor belts 141, 155, 160, 163 is halted, and the cover 112 comes to rest on the fixed pressing platform 37. Then as in the case of the first embodiment, a folding line is formed on the cover 112 by means of the fixed pressing platform 37 and the pressing plate 45, as well as holes on both sides of the folding line by means of the punches 46. Next, the round conveyor belts 141, 155, 160, 163 again rotate, and the cover 112 is carried toward the cover receiving platform 67. The cover 112 is detected by the photoelectric switch 172. The rotation of the round conveyor belts 141, 155, 160, 163 halts when the detection signal is received, and the movement of the cover 112 also stops.

While the cover 112 is being carried in the manner described above, the upper round conveyor belt 155 moves upward away from the lower round conveyor belt 141. Afterward, the drawing arm 144 rotates upward and again sucks a new cover 112 from the cartridge 130.

From here, the above procedures are repeated during the continuous operation of the device.

Inasmuch as many apparently widely different embodiments of this invention may be made without departing from its spirit and scope, it is to be understood that the invention is not limited to the specific embodiment except as defined in the appended claims.

What is claimed is:

1. A bag covering apparatus that puts a cover folded in two at a folding portion on an opening of a bag, comprising:

folding means that can operate to fold said cover in two at said folding portion, cover retaining means provided adjacent to said folding means, having at least two holding portions capable of holding said folding portion of said cover, said folding portion of said cover being inserted into each of said holding portions of said cover retaining means by the action of said folding means, said cover retaining means being movable such that when one of said holding portions faces said opening of said bag, the other one of said holding portions facing said folding means, and linking means, operationally connected to said cover retaining means, that makes said opening of said bag and said holding portions of said cover retaining means facing said opening of said bag approach each other by the action of said folding means, thereby positioning said cover on said opening of said bag.

2. A bag covering apparatus, as set forth in claim 1, further having a shaft rotatably supporting said cover retaining means, said holding portions being arranged at prescribed angles with said shaft as center.

3. A bag covering apparatus, as set forth in claim 2, in which two of said holding portions of said cover retaining means are provided at 180 degree intervals with said shaft as center, said linking means includes movement sustaining means, connected to said cover retaining means, for allowing reciprocating motion of said cover retaining means between said folding means and said opening of said bag, and pushing means, connected to said cover retaining means, for pushing said cover retaining means toward said folding means, said folding means includes a folding piece capable of reciprocating movement toward said holding portions of said cover retaining means, and in a state where said cover is contained in one of said holding portions of said cover retaining means facing said opening of said bag, said folding piece folds said cover in two at said folding portion, then moves toward the other holding portion and inserts said folding portion of said cover into said other holding portion, and by the movement of said cover retaining means toward said opening of said bag against the elastic force of said pushing means, the cover contained in said other holding portion is positioned on said opening of said bag.

4. A bag covering apparatus, as set forth in claim 3, that further includes rotating means which causes said cover retaining means to rotate 180 degrees about said shaft, said rotating means making said cover retaining means rotate 180 degrees with the movement of said folding means away from said cover retaining means, making said cover contained in said other holding portion face said opening of said bag.

5. A bag covering apparatus, as set forth in claim 1, in which said folding means includes a folding plate capable of reciprocating motion toward and away from said holding portion of said cover retaining means, and a cover receiving platform where said cover is set, provided between said folding plate and said cover retaining means, said cover receiving platform bearing a cover pushing hole having a configuration corresponding to the cross sectional configuration of said folding plate; said folding portion of said cover being formed by the action of the front end of said folding plate and said cover pushing hole when said folding plate passes through said cover pushing hole toward said cover retaining means.

6. A bag covering apparatus, as set forth in claim 5, that further includes containing means that holds said covers, positioned adjacent to said cover receiving platform, feeding means that feeds said cover from said containing means to said receiving platform, provided between said containing means and said receiving platform, and notch forming means that forms a folding line on said cover on said feeding means, provided between said containing means and said receiving platform, said cover being supplied to said receiving platform by said feeding means such that said folding line of said cover corresponds to said front end of said folding plate.

7. A bag covering apparatus, as set forth in claim 6, in which said containing means includes a cover roll in which a long strip of cover is wound; said feeding means includes a feeding roller operationally connected to said cover roll such that it rotates simultaneously with said cover roll, and a rotatable pressing roller positioned such that it can make contact with said feeding roller and follows the rotation of said feeding roller in the contact position; in the state where said feeding roller and said pressing roller are in the contact position, said long strip of cover is carried between said feeding roller and said pressing roller with the rotation of said feeding roller, and is conveyed to said receiving platform.

8. A bag covering apparatus, as set forth in claim 7, that further includes cutting means that cuts said long strip of cover and forms said cover, provided between said notch forming means and said receiving platform, and linking means that operationally links said notch forming means and said cutting means such that said notch forming means and said cutting means operate simultaneously.

9. A bag covering apparatus, as set forth in claim 6, in which said containing means includes a cartridge which contains a plurality of covers piled together and drawing means, provided between said cartridge and said feeding means, that draws and retains a piece of cover from said cartridge, as well as being capable of reciprocating motion between said cartridge and said feeding means.

10. A bag covering apparatus, as set forth in claim 9, in which said feeding means includes a first conveyor belt provided near said drawing means, and a second conveyor belt which can be situated at any one of two positions consisting of a conveying position where it overlaps on top of said first conveyor belt and an evacuating position where it moves away from said first conveyor belt; when said second conveyor belt is situated on said evacuating position, said drawing means retains and carries said cover onto said first conveyor belt, and when said second conveyor belt is situated on said conveying portion, said drawing means releases its hold on said cover, and said cover is carried by the coaction of said first and second conveyor belts.

11. A bag covering apparatus, as set forth in claim 10, in which said cartridge includes a stopper having a drawing outlet provided on the side facing said drawing means, and an attachment capable of movement toward said stopper, provided on the side away from said drawing means; said covers being sandwiched at upright positions between said stopper and said attachment.

12. A bag covering apparatus, as set forth in claim 11, that further includes moving means operationally connecting said drawing means and said attachment, that moves said attachment toward said stopper a distance equivalent to the thickness of said cover every time said drawing means moves toward said first conveyor belt.

* * * * *